US009418528B2

(12) United States Patent
Stokes

(10) Patent No.: US 9,418,528 B2
(45) Date of Patent: Aug. 16, 2016

(54) OVEN APPLIANCE WITH CAVITY FIRE DETECTION

(71) Applicant: General Electric Company, Schenectady, NY (US)

(72) Inventor: Andrea Nichole Stokes, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 134 days.

(21) Appl. No.: 14/310,121

(22) Filed: Jun. 20, 2014

(65) Prior Publication Data

US 2015/0371513 A1 Dec. 24, 2015

(51) Int. Cl.

| | |
|---|---|
| ***G08B 17/00*** | (2006.01) |
| ***G08B 17/06*** | (2006.01) |
| ***F24C 7/08*** | (2006.01) |
| ***G08B 17/117*** | (2006.01) |
| ***G08B 29/18*** | (2006.01) |
| *F24C 15/02* | (2006.01) |

(52) U.S. Cl.

CPC . *G08B 17/06* (2013.01); *F24C 7/08* (2013.01); *G08B 17/117* (2013.01); *G08B 29/183* (2013.01); *F24C 15/022* (2013.01)

(58) Field of Classification Search

CPC ..... G08B 29/043; F24C 14/02; F24C 7/087; F24C 3/128; F24C 7/082; F23N 2027/36; A47J 37/0676; A47J 36/00; H05B 1/0266; A23B 4/052; G05B 15/02; G01K 1/024

USPC ..... 340/589, 514, 628, 632, 686.6; 700/299, 300

See application file for complete search history.

(56) References Cited

U.S. PATENT DOCUMENTS

| | | | | |
|---|---|---|---|---|
| 5,791,890 | A | 8/1998 | Maughan | |
| 6,788,211 | B2 | 9/2004 | Kouznetsov et al. | |
| 8,931,400 | B1 * | 1/2015 | Allen | H04Q 9/00 340/870.09 |
| 2008/0082217 | A1 * | 4/2008 | Sung | F24C 7/082 700/299 |
| 2013/0201017 | A1 * | 8/2013 | Oppelt | G08B 29/043 340/514 |
| 2015/0025687 | A1 * | 1/2015 | Henderson | A23B 4/052 700/275 |
| 2015/0118630 | A1 * | 4/2015 | Ewell | H05B 1/0261 432/1 |
| 2015/0136430 | A1 * | 5/2015 | Livchak | F24C 15/2021 169/46 |
| 2015/0312964 | A1 * | 10/2015 | Sorenson | A47J 37/0611 219/448.13 |

FOREIGN PATENT DOCUMENTS

| | | | |
|---|---|---|---|
| CN | 1455173 | A | 11/2003 |
| DE | 102011105597 | A1 | 12/2012 |

OTHER PUBLICATIONS

ISDU: Integrated Smoke Detector Unit for Commercial Microwave Ovens, Lloyd et al., Electrical and Computer Engineering Undergraduate Capstone Project-Paper 7, dated Apr. 17, 2007, 38 pages.

* cited by examiner

*Primary Examiner* — Mirza Alam
(74) *Attorney, Agent, or Firm* — Dority & Manning, PA

(57) ABSTRACT

An oven appliance with features for detecting and containing a fire and/or smoke within the cooking chamber of the oven appliance is provided. A method for operating an oven appliance to detect and contain a fire and/or smoke within the cooking chamber of the oven appliance is also provided.

17 Claims, 5 Drawing Sheets

OVEN APPLIANCE WITH CAVITY FIRE DETECTION

FIELD OF THE INVENTION

The subject matter of the present disclosure relates generally to an oven appliance with features for detecting and containing a fire and/or smoke within the oven cavity.

BACKGROUND OF THE INVENTION

Oven appliances generally include a cabinet that defines a cooking chamber for baking or broiling food items therein. Oven appliances also generally include a self-cleaning feature for cleaning the cooking chamber. To heat the cooking chamber for baking, broiling, or self-cleaning, oven appliances include one or more heating elements, such as gas burners or electric resistance elements, which may be positioned at a top and/or bottom portion of the cooking chamber. During self-cleaning, particularly high temperatures are generated in the cooking chamber. Additionally, during baking and broiling operations, food items may be overcooked or may char or burn if a user is inattentive. Under certain conditions, smoke and/or a fire may even occur within the cooking chamber. However, the user may be unaware that such conditions have developed, and the user could be exposed to dangers posed by smoke and/or fire if the user is unaware that such conditions exist in the cooking chamber of the oven appliance. For example, the user could open the door of the oven appliance and thereby allow smoke to escape or provide fresh air that could fuel a fire.

Accordingly, an oven appliance with features for detecting a fire and/or smoke within the cooking chamber would be useful. Further, an oven appliance having features for containing a fire and/or smoke within the cooking chamber would be beneficial. Moreover, a method for using the features of an oven appliance to detect and contain a fire and/or smoke within the cooking chamber of the oven appliance also would be useful.

BRIEF DESCRIPTION OF THE INVENTION

The present invention provides an oven appliance with features for detecting and containing a fire and/or smoke within the cooking chamber of the oven appliance. A method for operating an oven appliance to detect and contain a fire and/or smoke within the cooking chamber of the oven appliance is also provided. Additional aspects and advantages of the invention will be set forth in part in the following description, may be apparent from the description, or may be learned through practice of the invention.

In a first exemplary embodiment, an oven appliance includes a cabinet defining an opening at a front portion of the cabinet. The cabinet also defines a cooking chamber configured for receipt of food items for cooking. The cooking chamber comprises a top wall, a bottom wall, a back wall, and opposing side walls. The oven appliance also includes a door mounted to the cabinet at the opening of the cabinet; the door is selectively adjustable between an open position and a closed position to permit selective access to the cooking chamber through the opening of the cabinet. Further, the oven appliance includes a heating element configured to heat the cooking chamber, and the heating element has an energy source. The oven appliance also includes a vent for exhausting fumes and gases generated during cooking from the cooking chamber; a temperature sensor; and a controller. The controller is configured for monitoring a rate of temperature change $\Delta T$ within the cooking chamber; comparing the rate of temperature change $\Delta T$ within the cooking chamber to a reference rate of temperature change $\Delta T_{ref}$ to determine if there is a fire in the cooking chamber and, if so, then providing a warning to a user of the oven appliance and containing the fire within the cooking chamber.

In a second exemplary embodiment, an oven appliance includes a cabinet defining an opening at a front portion of the cabinet. The cabinet also defines a cooking chamber configured for receipt of food items for cooking. The cooking chamber comprises a top wall, a bottom wall, a back wall, and opposing side walls. The oven appliance also includes a door mounted to the cabinet at the opening of the cabinet; the door is selectively adjustable between an open position and a closed position to permit selective access to the cooking chamber through the opening of the cabinet. Further, the oven appliance includes a heating element configured to heat the cooking chamber, and the heating element has an energy source. The oven appliance also includes a vent for exhausting fumes and gases generated during cooking from the cooking chamber; a temperature sensor; and a controller. The controller is configured for monitoring a current gas level; comparing the current gas level to a reference gas level to determine if there is a fire in the cooking chamber and, if so, then providing a warning to a user of the oven appliance and containing the fire within the cooking chamber.

In a third exemplary embodiment, a method is provided. The method includes the steps of monitoring a rate of temperature change $\Delta T$ within a cooking chamber of the oven appliance; comparing the rate of temperature change $\Delta T$ within the cooking chamber to a reference rate of temperature change $\Delta T_{ref}$ to determine if there is a fire in the cooking chamber and, if so, then providing a warning to a user of the oven appliance and containing the fire within the cooking chamber.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
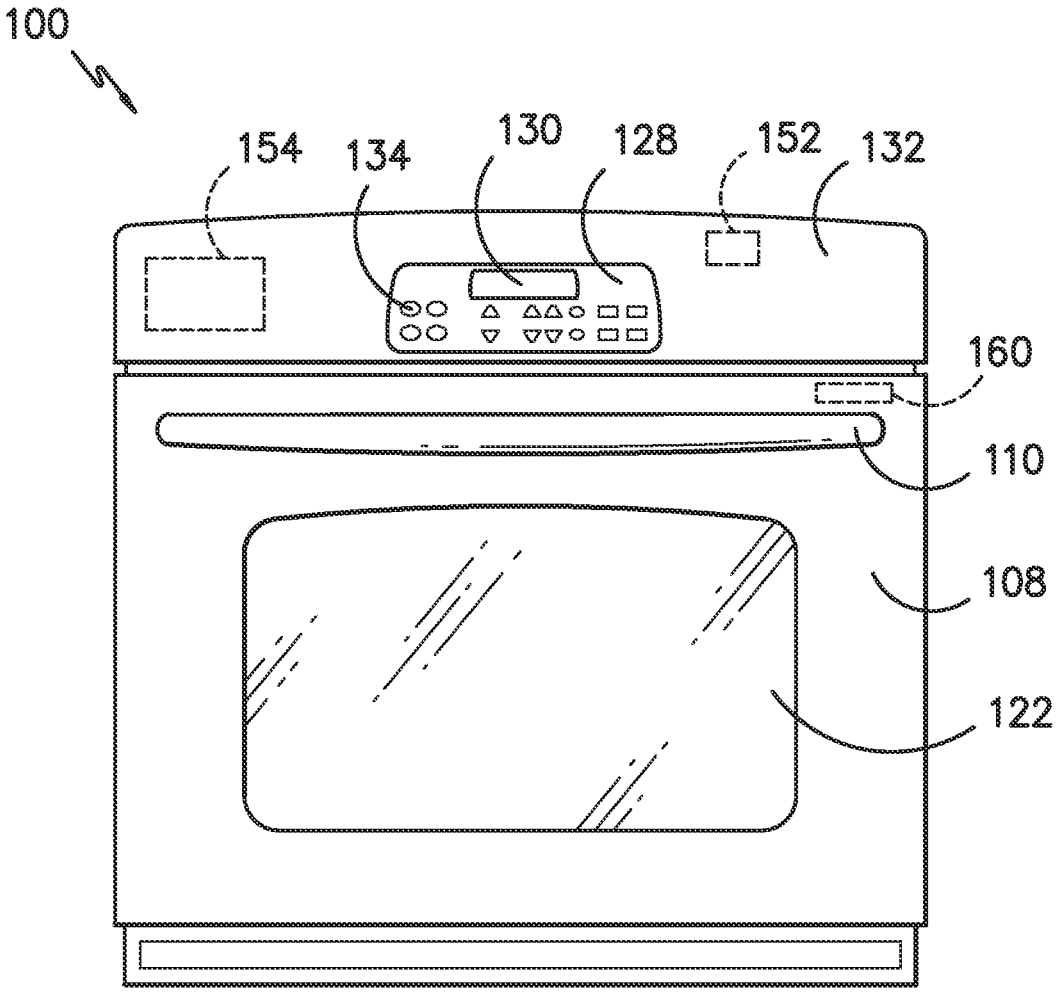
FIG. 1 provides a front view of an exemplary embodiment of an oven appliance of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
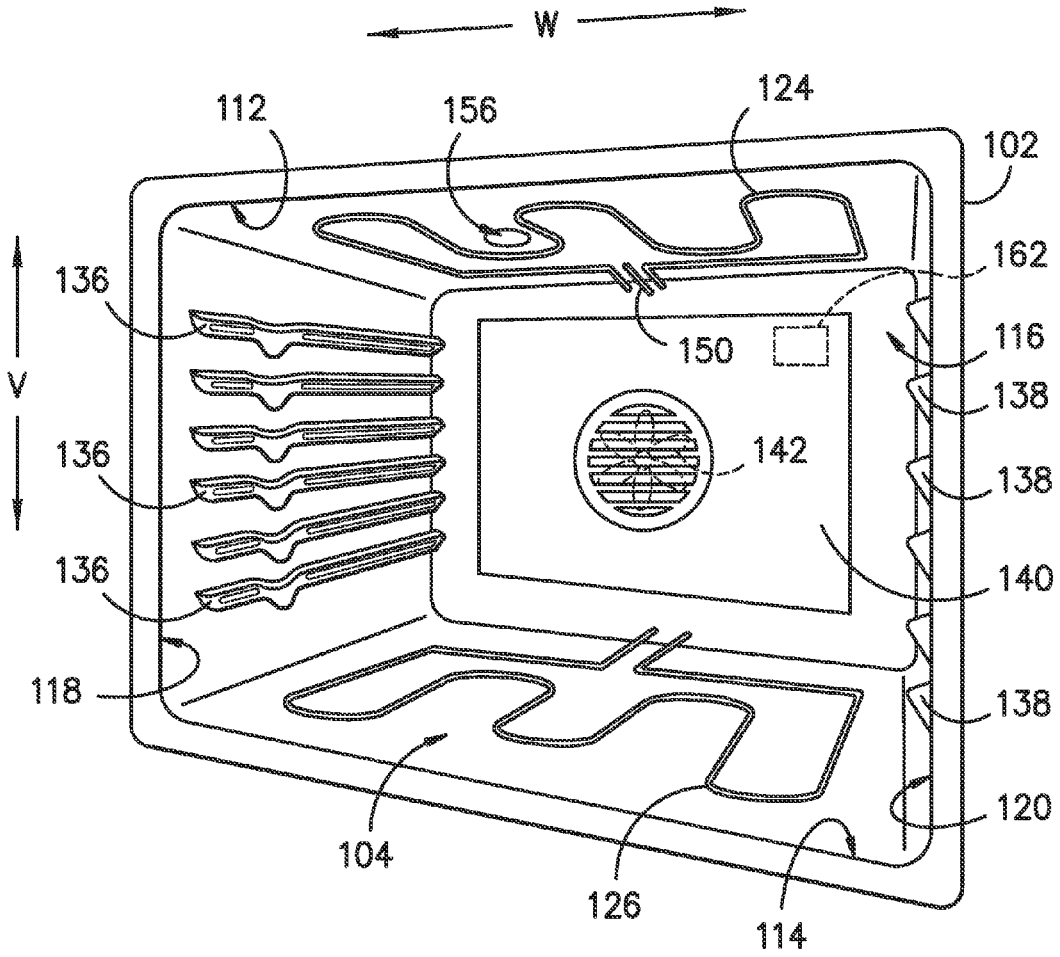
FIG. 2 is a perspective view of a cooking chamber of an exemplary embodiment of an oven appliance of the present subject matter.

Referring to FIGS. 1 and 2, for this exemplary embodiment, oven appliance 100 includes an insulated cabinet 102 with an interior cooking chamber 104 defined by a top wall 112, a bottom wall 114, a back wall 116, and opposing side walls 118, 120. Cooking chamber 104 is configured for the receipt of one or more food items to be cooked. Oven appliance 100 includes a door 108 pivotally mounted, e.g., with one or more hinges (not shown), to cabinet 102 to permit selective access to cooking chamber 104. A handle 110 is mounted to door 108 and assists a user with opening and closing door 108. For example, a user can pull on handle 110 to open or close door 108 and access cooking chamber 104. Further, door 108 includes a door lock 160, which may be engaged to prevent access to cooking chamber 104 through door 108, e.g., during a self-cleaning operation of oven appliance 100.

Oven appliance 100 can include a seal (not shown) between door 108 and cabinet 102 that assists with maintaining heat and cooking fumes within cooking chamber 104 when door 108 is closed as shown in FIG. 1. Multiple parallel glass panes 122 provide for viewing the contents of cooking chamber 104 when door 108 is closed and assist with insulating cooking chamber 104. A baking rack (not shown) for the receipt of food items or utensils containing food items may be slidably received onto embossed ribs or sliding rails 136, 138 such that the rack may be conveniently moved into and out of cooking chamber 104 when door 108 is open.

A heating element at the top, bottom, or both of cooking chamber 104 provides heat from an energy source to cooking chamber 104 for cooking. Such heating element(s) can be gas, electric, microwave, or a combination thereof. For example, in the embodiment shown in FIG. 2, oven appliance 100 includes a top heating element 124 and a bottom heating element 126, which are connected to an energy source 162.

Oven appliance 100 also may include a convection fan 142 positioned adjacent back wall 116 to provide air movement in cooking chamber 104 during, e.g., convection modes of oven appliance 100. As shown in FIG. 2, a panel 140 protects fan 142. Other configurations of convection fan 142 may be used as well.

Referring now to FIG. 1, oven appliance 100 includes a user interface 128 having a display 130 positioned on an interface panel 132 and having a variety of controls 134. Interface 128 allows the user to select various options for the operation of oven 100 including, e.g., temperature, time, and/or various cooking and cleaning cycles. Operation of oven appliance 100 can be regulated by a controller 154 that is operatively coupled, i.e., in communication with, user interface 128, heating elements 124, 126, door lock 160, and/or other components of oven 100. For example, in response to user manipulation of the user interface 128, controller 154 can operate the heating element(s). The controller can receive measurements from a temperature sensor 150 placed in cooking chamber 104 and, e.g., provide a temperature indication to the user with display 130. Alternatively, controller 154 can be enabled with wireless communication components (e.g., "Wi-Fi") to provide such temperature indication to the user through another wireless communication enabled device such as, e.g., a cellular phone, tablet computer, or the like. Other forms of communication may be included as well including e.g., a wired connection. Controller 154 can also be provided with other features as will be further described herein.

Controller 154 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor.

Controller 154 may be positioned in a variety of locations throughout oven appliance 100. In the illustrated embodiment, controller 154 is located next to user interface 128 within interface panel 132. In other embodiments, controller 154 may be located under or over user interface 128 or otherwise within interface panel 132, or controller 154 may be located at any other appropriate location with respect to oven appliance 100. In the embodiment shown in FIG. 1, input/output ("I/O") signals are routed between controller 154 and various operational components of oven appliance 100 such as heating elements 124, 126, controls 134, display 130, door lock 160, temperature sensor 150, alarms, and/or other components as may be provided. In one embodiment, the user interface 128 may represent a general purpose I/O ("GPIO") device or functional block.

Although shown with touch type controls 134, it should be understood that controls 134 and the configuration of oven appliance 100 shown in FIG. 1 is provided by way of example only. More specifically, user interface 128 may include various input components, such as one or more of a variety of electrical, mechanical, or electro-mechanical input devices including rotary dials, push buttons, and touch pads. The user interface 128 may include other display components, such as a digital or analog display device designed to provide operational feedback to a user. User interface 128 may be in communication with controller 154 via one or more signal lines or shared communication busses.

While oven 100 is shown as a wall oven, the present invention could also be used with other cooking appliances such as, e.g., a stand-alone oven, an oven with a stove-top, or other configurations of such ovens.

Figure 3:
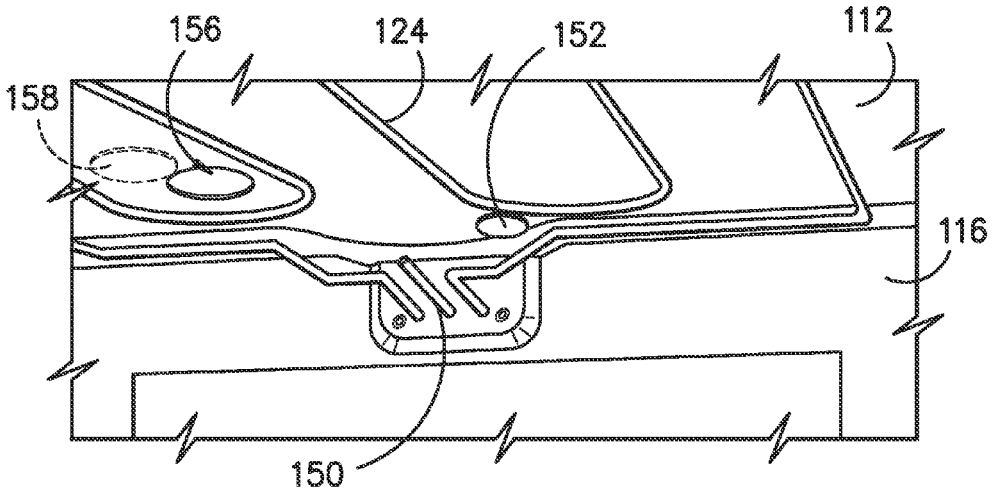
FIG. 3 is a perspective view of a top portion of a cooking chamber of an exemplary embodiment of an oven appliance of the present subject matter, with a damper shown in the open position.
Figure 4:
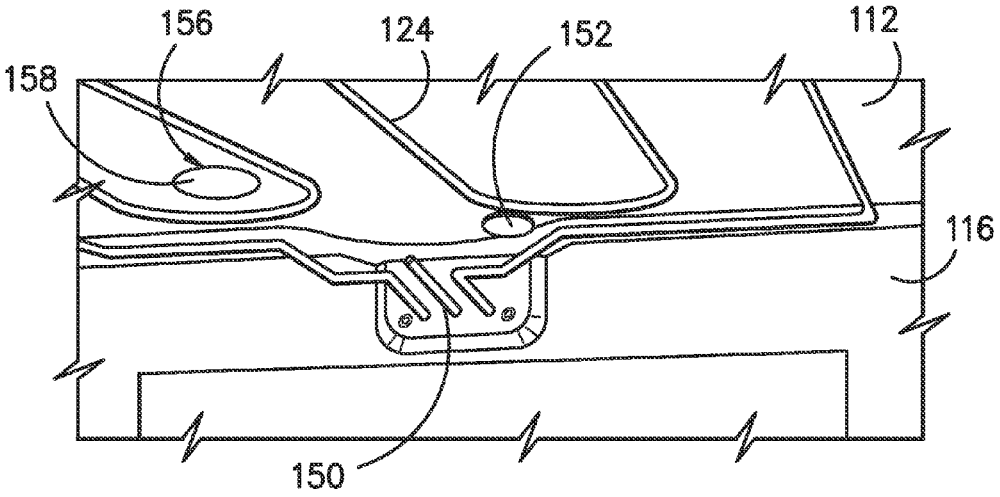
FIG. 4 is the perspective view of the top portion of a cooking chamber of the exemplary embodiment shown in FIG. 3, except with the damper shown in the closed position.

Referring now to FIGS. 3 and 4, an exemplary embodiment of oven appliance 100 is shown with a vent 156 in top wall 112. Vent 156 allows fumes and gases generated during cooking to exhaust from cooking chamber 104. Oven appliance 100 also includes a damper 158 in operative communication with controller 154. Damper 158 is positioned such that, when controller 154 selectively operates damper 158, damper 158 opens vent 156 as shown in FIG. 3 or closes vent 156 as shown in FIG. 4. As illustrated in FIGS. 3 and 4, vent 156 may be configured as an opening in top wall 112; in alternative embodiments, more than one vent may be used and each vent may have an associated damper. Alternatively, one damper may be configured to close more than one vent. In still other embodiments, the one or more vents may be positioned at other locations in cooking chamber 104.

As illustrated, temperature sensor 150 may be located adjacent top wall 112. In alternative embodiments, temperature sensor 150 may be positioned in another location within cooking chamber 104. In still other embodiments, oven appliance 100 may include more than one temperature sensor. Temperature sensor 150 may be a resistive temperature device (RTD) or any other suitable sensor.

In addition to temperature sensor 150, oven appliance 100 may include a gas sensor 152. Gas sensor 152 measures the level of a gas or several gases, such as CO, $CO_2$, or the like, in cooking chamber 104. In certain embodiments, gas sensor 152 is positioned in cooking chamber 104, as shown in FIGS. 3 and 4. In other embodiments, gas sensor 152 may be positioned outside cooking chamber 104, as shown in FIG. 1. Gas sensor 152 may be positioned in other locations as well, and certain embodiments may utilize more than one gas sensor positioned at various locations of oven appliance 100. Gas sensor 152 may be a metal oxide semiconductor (MOS) sensor array or any other suitable sensor.

During the operation of oven appliance 100, food items placed in cooking chamber 104 for cooking or food items that have fallen onto bottom wall 114 of cooking chamber 104 may burn or overcook, or cooking chamber 104 may become overheated, which could lead to a fire and/or smoke in cooking chamber 104. Thus, oven appliance 100 may include features for detecting and containing and/or extinguishing fire and smoke within cooking chamber 104.

For example, temperature sensor 150 may be in communication with controller 154, and temperature values detected by temperature sensor 150 may be used by controller 154 to determine the rate of temperature change ΔT in cooking chamber 104. If the rate of temperature change ΔT reaches at least a reference rate of temperature change $\Delta T_{ref}$, controller 154 may thereby detect a fire or other potentially harmful thermal event in cooking chamber 104 and implement measures to contain and/or extinguish the fire and protect a user of the oven appliance from the thermal event, as further described below. In other embodiments, controller 154 may compare a current temperature T measured by temperature sensor 150 to a threshold temperature $T_{thr}$ to determine if there is a fire or other potentially harmful thermal event within cooking chamber 104. That is, if the current temperature T reaches at least the threshold temperature $T_{thr}$, controller 154 may thereby detect a fire or other thermal event in cooking chamber 104 and implement measures to contain and/or extinguish the fire and protect a user of the oven appliance from the thermal event. The reference rate of temperature change $\Delta T_{ref}$ and the threshold temperature $T_{thr}$ may be stored in controller 154 or any other suitable device.

As a further example, gas sensor 152 may be in communication with controller 154, and gas levels detected by gas sensor 152 may be used by controller 154 to monitor cooking chamber 104. If the current gas level reaches at least a baseline gas level, controller 154 may thereby determine that a fire or other potentially harmful event within cooking chamber 104. Controller 154 may then implement measures to contain and/or extinguish the fire and protect a user of the oven appliance from the event, as further described below. The baseline gas level may be the gas level determined when oven appliance 100 is first assembled or installed, and in certain embodiments, the baseline gas level may be determined after, e.g., each self-cleaning operation of oven appliance 100. The baseline gas level may be stored in controller 154 or any other suitable device.

Figure 5:
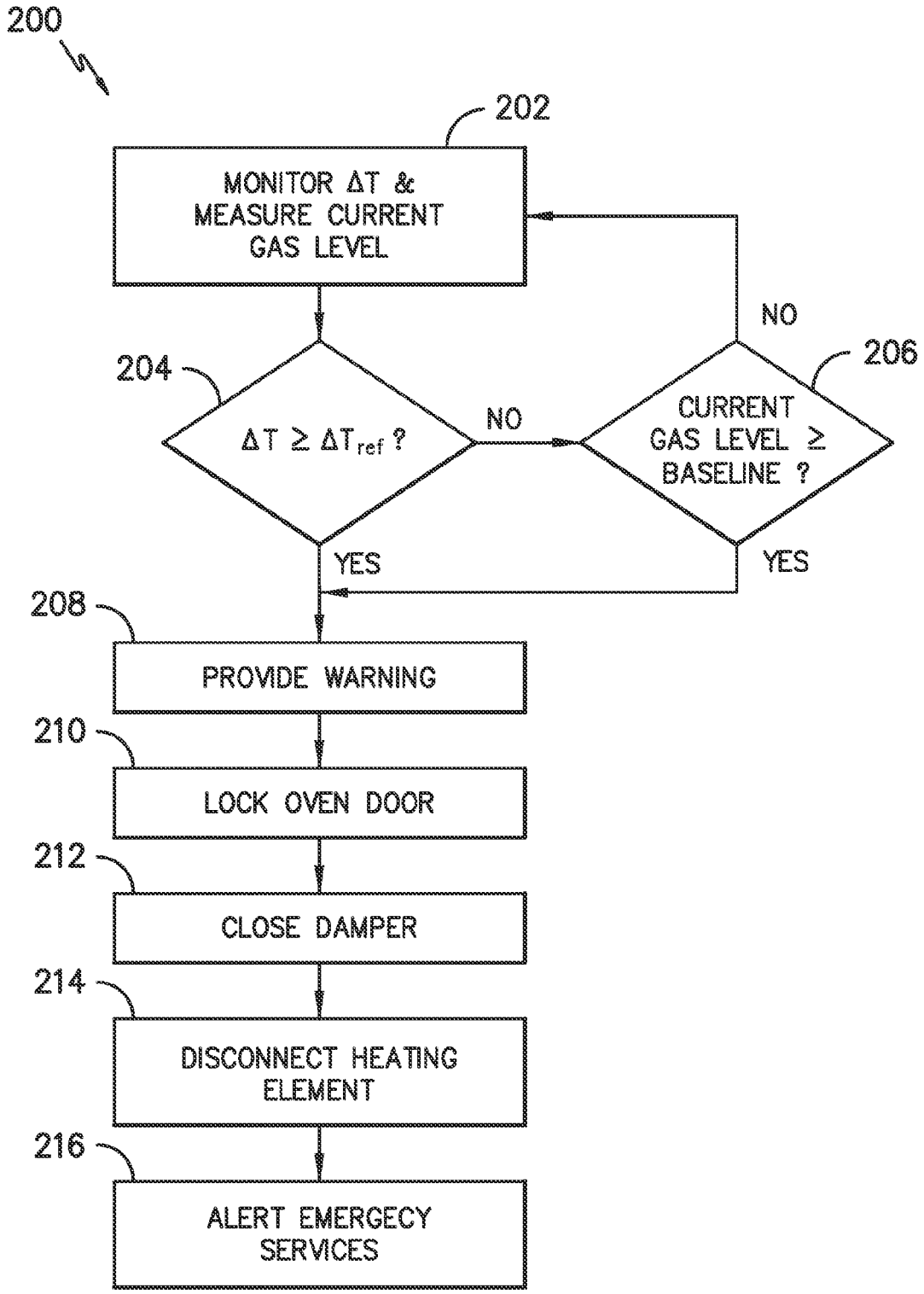
FIG. 5 illustrates a method of operating an oven appliance in accordance with one exemplary embodiment of the present subject matter.

FIG. 5 illustrates one exemplary method 200 for operating oven appliance 100. The exemplary method includes step 202 of monitoring the rate of temperature change ΔT in cooking chamber 104 and measuring the current gas level. At step 204, the rate of temperature change ΔT is compared to the reference rate of temperature change $\Delta T_{ref}$. If the rate of temperature change ΔT has not reached at least the reference rate of temperature change $\Delta T_{ref}$, the method proceeds to step 206, where the current gas level is compared to the baseline gas level. If the current gas level has not reached at least the baseline gas level, the method returns to step 202. However, if at step 204 the rate of temperature change ΔT has reached at least the reference rate of temperature change $\Delta T_{ref}$, or if at step 206 the current gas level has reached at least the baseline gas level, the method proceeds to step 208, implementing measures to contain and/or extinguish the fire and protect the user of the oven appliance. The order of steps 204 and 206 can be changed or even operated simultaneously.

At step 208, a warning is provided to a user of oven appliance 100 that there is a fire or other potentially harmful event, such as, e.g., very high temperatures or smoke, in cooking chamber 104. The warning may be any audible and/or visual signal that indicates to the user that a fire or other potentially harmful event has been detected in cooking chamber 104. By way of example, the warning may be a notification displayed on user interface 128, an LED light, a buzzer, and/or any other appropriate visual and/or audible signal.

At step 210, door lock 160 of oven door 108 is engaged to lock the oven door. Locking door 108 prevents the user from accessing cooking chamber 104 and being injured by, e.g., flames or smoke. At step 212, damper 158 is operated to close vent 156. Closing vent 156 reduces the oxygen available to fuel a fire within cooking chamber 104, which could help extinguish a fire within cooking chamber 104. Closing vent 156 may also help contain any smoke within cooking chamber 104. Similarly, convection fan 142 could be deactivated to diminish air movement within cooking chamber 104. Further, at step 214 of method 200, heating elements 124, 126 are disconnected from energy source 162 to prevent the addition of heat to cooking chamber 104 through heating elements 124, 126.

Method 200 also includes step 216 of alerting emergency services to a possible fire. In certain embodiments, controller 154 may alert emergency services to a possible fire in oven appliance 100 through the wireless or wired communication connection described above. In alternative embodiments, step 216 may include providing an audible and/or visible instruction to a user, e.g., through user interface 128, to alert emergency services.

As described above, in alternative embodiments, oven appliance 100 may include more than one vent and damper, and each vent may be closed by a damper at step 212. Additionally, oven appliance 100 may include a convection heating element that also is disconnected from its energy source at step 214. Other configurations of oven appliance 100 may also be used, and method 200 may include steps to contain a fire and/or smoke within oven appliance 100, or to protect a user of the oven appliance, based on other configurations of oven appliance 100.

Figure 6:
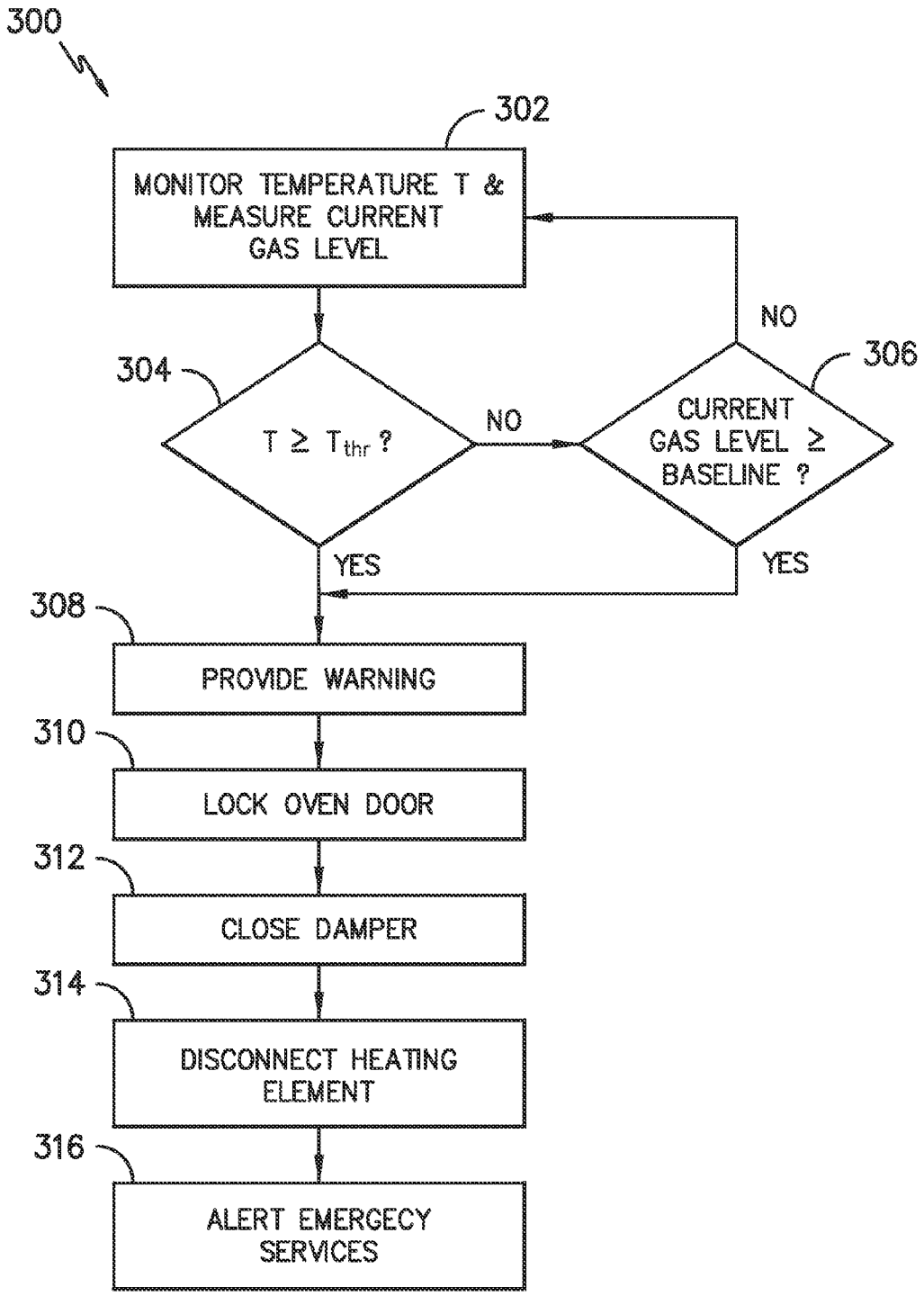
FIG. 6 illustrates a method of operating an oven appliance in accordance with another exemplary embodiment of the present subject matter.

FIG. 6 illustrates another exemplary method 300 for operating oven appliance 100. The exemplary method includes step 302 of monitoring the temperature T in cooking chamber 104 and measuring the current gas level. At step 304, the temperature T is compared to a threshold temperature $T_{thr}$. If the temperature T has not reached at least the threshold temperature $T_{thr}$, the method proceeds to step 306, where the current gas level is compared to the baseline gas level. If the current gas level has not reached at least the baseline gas level, the method returns to step 302. However, if at step 304 the temperature T within cooking chamber 104 has reached at least the threshold temperature $T_{thr}$, or if at step 306 the current gas level has reached at least the baseline gas level, the method proceeds to step 308, implementing measures to contain and/or extinguish the fire and protect the user of the oven appliance. Also, it is noted the order of steps 304 and 306 can be changed or even operated simultaneously.

At step 308, a warning is provided to a user of oven appliance 100 that there is a fire or other potentially harmful event, such as, e.g., very high temperatures or smoke, in cooking chamber 104. As described, the warning may be any audible and/or visual signal, such as a notification displayed on user interface 128, an LED light, and/or a buzzer, that indicates to the user that a fire or other potentially harmful event has been detected in cooking chamber 104. At step 310, door lock 160 of oven door 108 is engaged to lock the oven door and prevent the user from accessing cooking chamber 104. At step 312, damper 158 is operated to close vent 156. As described, convection fan 142 also could be deactivated to diminish air movement within cooking chamber 104. Further, at step 314, heating elements 124, 126 are disconnected from energy source 162 to prevent the addition of heat to cooking chamber 104 through heating elements 124, 126. At step 316, emergency services are alerted to a possible fire through, e.g., the wireless or wired communication connection of oven appliance 100, or an audible and/or visible instruction is provided to a user, e.g., through user interface 128, to alert emergency services.

As described above, in alternative embodiments, oven appliance 100 may include more than one vent and damper, and each vent may be closed by a damper at step 312. Additionally, oven appliance 100 may include a convection heating element that also is disconnected from its energy source at step 314. Other configurations of oven appliance 100 may also be used, and method 300 may include steps to contain a fire and/or smoke within oven appliance 100, or to protect a user of the oven appliance, based on other configurations of oven appliance 100. For example, a combination of the embodiments of FIGS. 5 and 6 may be used that includes both $T_{thr}$ and $\Delta T_{ref}$.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An oven appliance, comprising:

a cabinet defining an opening at a front portion of the cabinet, the cabinet also defining a cooking chamber configured for receipt of food items for cooking, the cooking chamber comprising a top wall, a bottom wall, a back wall, and opposing side walls;

a door mounted to the cabinet at the opening of the cabinet, the door being selectively adjustable between an open position and a closed position to permit selective access to the cooking chamber through the opening of the cabinet;

a heating element configured to heat the cooking chamber, the heating element having an energy source;

a vent defined in one of the top wall, bottom wall, back wall, or opposing side walls of the cooking chamber for exhausting fumes and gases generated during cooking from the cooking chamber;

a temperature sensor; and a controller, the controller configured for measuring a temperature T within the cooking chamber;

monitoring a rate of temperature change $\Delta T$ within the cooking chamber;

identifying whether the temperature T has reached at least a threshold temperature $T_{thr}$;

comparing the rate of temperature change $\Delta T$ within the cooking chamber to a reference rate of temperature change $\Delta T_{ref}$;

providing a warning to a user of the oven appliance if the rate of temperature change $\Delta T$ has reached at least the reference rate of temperature change $\Delta T_{ref}$; and implementing measures to protect the user of the oven appliance if the controller determines there is a fire within the cooking chamber.

2. The oven appliance of claim 1, further comprising a gas sensor positioned within the cooking chamber, wherein the controller is further configured for measuring a current gas level;

identifying whether the current gas level has reached at least a baseline gas level to determine if there is a fire in the cooking chamber;

providing the warning to the user of the oven appliance if the current gas level has reached at least the baseline gas level; and implementing pleasures to protect the user of the oven appliance if the controller determines there is a fire within the cooking chamber.

3. The oven appliance of claim 1, further comprising a gas sensor positioned outside the cooking chamber, wherein the controller is further configured for measuring a current gas level;

identifying whether the current gas level has reached at least a baseline gas level to determine if there is a fire in the cooking chamber;

providing the warning to the user of the oven appliance if the current gas level has reached at least the baseline gas level; and implementing measures to protect the user of the oven appliance if the controller determines there is a fire within the cooking chamber.

4. The oven appliance of claim 1, further comprising a damper for closing the vent, wherein the controller is further configured for activating the damper to close the vent to protect the user of the oven appliance.

5. The oven appliance of claim 1, further comprising a user interface, wherein the controller is further configured for providing the warning by displaying a visual warning on the user interface.

6. The oven appliance of claim 1, further comprising a door lock, wherein the controller is further configured for engaging the door lock to protect the user of the oven appliance.

7. The oven appliance of claim 1, wherein the controller is further configured for disconnecting the heating element from the energy source to protect the user of the oven appliance.

8. An oven appliance, comprising:

a cabinet defining an opening at a front portion of the cabinet, the cabinet also defining a cooking chamber configured for receipt of food items for cooking, the cooking chamber comprising a top wall, a bottom wall, a back wall, and opposing side walls;

a door mounted to the cabinet at the opening of the cabinet, the door being selectively adjustable between an open position and a closed position to permit selective access to the cooking chamber through the opening of the cabinet;

a heating element configured to heat the cooking chamber, the heating element having an energy source;

a vent defined in one of the top wall, bottom wall, back wall, or opposing side walls of the cooking chamber for exhausting fumes and gases generated during cooking from the cooking chamber;

a gas sensor; and a controller, the controller configured for measuring a current gas level;

measuring a rate of temperature change $\Delta T$ within the cooking chamber;

comparing the current gas level to a baseline gas level;

identifying whether the current gas level has reached at least the baseline gas level to determine if there is a fire in the cooking chamber;

identifying whether a rate of temperature change $\Delta T$ has reached at least a reference rate of temperature change $\Delta T_{ref}$;

providing a warning to a user of the oven appliance if the current gas level has reached at least the reference gas level; and implementing measures to protect the user of the oven appliance if the controller determines there is a fire within the cooking chamber.

9. The oven appliance of claim 8, further comprising a damper for closing the vent, wherein the controller is further configured for activating the damper to close the vent to protect the user of the oven appliance.

10. The oven appliance of claim 8, further comprising a user interface, wherein the controller is further configured for providing the warning by displaying the warning on the user interface.

11. The oven appliance of claim 8, further comprising a door lock, wherein the controller is further configured for engaging the door lock to protect the user of the oven appliance.

12. The oven appliance of claim 8, wherein the controller is further configured for disconnecting the heating element from the energy source to protect the user of the oven appliance.

13. The oven appliance of claim 8, wherein the gas sensor is positioned outside the cooking chamber.

14. A method for operating an oven appliance, the method comprising:

monitoring a temperature T within a cooking chamber of the oven appliance;

measuring a rate of temperature change $\Delta T$ within the cooking chamber;

comparing the temperature T within the cooking chamber to a threshold temperature $T_{thr}$ and identifying whether a rate of temperature change $\Delta T$ has reached at least a reference rate of temperature change $\Delta T_{ref}$ to determine if there is a fire in the cooking chamber;

providing a warning to a user of the oven appliance if the temperature T is at least equal to the threshold temperature $T_{thr}$ and the rate of temperature change $\Delta T$ has reached at least the reference rate of temperature change $\Delta T_{ref}$; and implementing measures to protect the user of the oven appliance if the controller determines there is a fire within the cooking chamber, wherein implementing measures to protect the user of the oven appliance comprises activating a damper of the oven appliance to close a vent for exhausting fumes and gases generated during cooking from a cooking chamber of the oven appliance;

engaging a door lock of the oven appliance to prevent a user from opening a door of the oven appliance; and disconnecting a heating element of the oven appliance from an enemy source.

15. The method of claim 14, wherein providing the warning to the user comprises displaying the warning on a user interface of the oven appliance.

16. The method of claim 14, further comprising:

measuring a current gas level;

identifying whether the current gas level has reached at least a baseline gas level to determine if there is a fire in the cooking chamber;

providing the warning to the user of the oven appliance if the current gas level has reached at least the baseline gas level; and implementing measures to protect the user of the oven appliance if the controller determined there is a fire within the cooking chamber.

17. The oven appliance of claim 1, wherein the warning provided to the user of the oven appliance indicates to the user that a fire has been detected in the cooking chamber.

* * * * *